US006978513B2

(12) United States Patent
Harlacker et al.

(10) Patent No.: US 6,978,513 B2
(45) Date of Patent: Dec. 27, 2005

(54) METHOD AND APPARATUS FOR STOPPING A MOVING MEMBER

(75) Inventors: David S. Harlacker, Monroe, CT (US); John Marini, Trumbull, CT (US); Harvey Schneider, Southbury, CT (US)

(73) Assignee: Kendro Laboratory Products, LP, Newtown, CT (US)

( * ) Notice: Subject to any disclaimer, the term of this patent is extended or adjusted under 35 U.S.C. 154(b) by 292 days.

(21) Appl. No.: 10/400,923

(22) Filed: Mar. 28, 2003
(Under 37 CFR 1.47)

(65) Prior Publication Data

US 2005/0022341 A1 Feb. 3, 2005

(51) Int. Cl.[7] ..... E05F 5/02
(52) U.S. Cl. ..... 16/82; 16/86 A; 16/91; 16/96 R
(58) Field of Search ..... 16/82, 85, 86 R, 16/86 A, 86 B, 91, 93 R, 90, 94 R, 96 R, 16/102, 106; 49/425; 312/330.1, 334.44, 312/334.45; 292/DIG. 46, DIG. 56; 296/155, 296/146.9; 494/16, 20, 26, 60, 38–41

(56) References Cited

U.S. PATENT DOCUMENTS

| | | | | |
|---|---|---|---|---|
| 3,391,862 | A * | 7/1968 | Jacobson et al. | 494/39 |
| 3,986,742 | A * | 10/1976 | Heaney | 292/268 |
| 4,121,878 | A * | 10/1978 | Lokken | 312/334.45 |
| 4,692,035 | A * | 9/1987 | Rock et al. | 384/18 |
| 4,692,960 | A * | 9/1987 | Jozefczak | 16/86 A |
| 4,733,499 | A * | 3/1988 | Guddas | 49/404 |
| 5,004,453 | A * | 4/1991 | Hayasaka et al. | 494/39 |
| 5,634,703 | A * | 6/1997 | Vonier | 312/334.12 |
| 5,718,083 | A * | 2/1998 | Dowdell, II | 49/407 |
| 5,836,111 | A * | 11/1998 | Tak | 49/425 |
| 5,895,089 | A * | 4/1999 | Singh et al. | 296/207 |
| 5,906,026 | A * | 5/1999 | Junttila | 16/85 |
| 6,059,130 | A * | 5/2000 | Grainger | 211/183 |
| 6,487,754 | B1 * | 12/2002 | Keen | 16/306 |
| 6,626,509 | B2 * | 9/2003 | Remmers | 312/334.7 |

FOREIGN PATENT DOCUMENTS

| | | | | |
|---|---|---|---|---|
| DE | 4028878 A1 * | 3/1991 | | A47B 88/04 |
| GB | 1548896 A * | 7/1979 | | B61K 7/16 |

* cited by examiner

*Primary Examiner*—Chuck Y. Mah
(74) *Attorney, Agent, or Firm*—Baker & Hostetler LLP

(57) ABSTRACT

A system and method for stopping a moving member located on a stationary member. The system includes sliders or rollers configured to move along a track. The track has a discontinuity to move the moving member to engage a friction pad to slow the moving member. The system includes a striker configured to engage a stop for stopping the moving member. The method includes moving the member along a pathway, altering the movement of the member with a discontinuity in the pathway, slowing the member at the discontinuity with a friction device engaged by the altered movement of the member, stopping the member with a resilient device, and preventing the member from bouncing back from the resilient device a significant amount with the friction device.

9 Claims, 5 Drawing Sheets

METHOD AND APPARATUS FOR STOPPING A MOVING MEMBER

FIELD OF THE INVENTION

The present invention relates generally to a method and apparatus for stopping a moving member such as a door. More particularly, the present invention relates to stopping a rolling or sliding door and reducing or minimizing the amount the door bounces back after it hits a stop.

BACKGROUND OF THE INVENTION

Many appliances or other pieces of equipment have access doors. These access doors may provide access to parts of the appliance for maintenance reasons, or the doors may permit work pieces processed by the equipment to be loaded or unloaded to and from the equipment. For example, a centrifuge typically contains a rotor located in an interior position of the centrifuge, accessible by an access door. The access door is moved by rolling or sliding the door along a track. Moving the door permits an operator of the centrifuge access to the rotor.

After the door has achieved an open position, the door is stopped in its movement by a stop which prevents the door from moving beyond a desired open position. However, if the door encounters the stop at too high a velocity, the door may bounce back away from the fully open position and may restrict, or at least partially restrict, access to the rotor or the chamber for which the door was covering. The amount a door may bounce back often depends upon how quickly the door was opened and the speed the door was going when it encountered the stop. Effects of the bounce back may range from a simple annoyance of having to move the door out of the way a second time, to more serious consequences that may result from the door quickly bouncing back when the return movement is not anticipated by an operator.

Accordingly, it is desirable to provide a method and apparatus that permits a door to be rolled or slid away at and encounter a stop without bouncing back or at least minimizing or reducing the distance the door bounces back.

SUMMARY OF THE INVENTION

The foregoing needs are met, to a great extent, by the present invention, wherein in one aspect, an apparatus is provided that permits a door to be rolled or slid away and encounter a stop without bouncing back or at least with a reduction in the amount the door bounces back.

In accordance with one embodiment of the present invention, a stopping system for stopping a moving member located on stationary member is provided. The system includes a roller or a slider attached to either the moving member or the stationary member. The system further includes a track connected to the moving or stationary member which is not attached to the roller or slider member, and the track is configured to define a path for the roller or slider. A striker pad is connected to either the moving member or the stationary member, and a striker is connected to the moving or stationary member which is not connected to the striker pad. The striker and striker pad are configured to contact each other to stop the moving member from moving in a first direction along the track, and a friction pad is configured to resist the moving member from bouncing back from a collision of the striker and striker pad and moving in a second direction substantially opposite the first direction. The friction pad is configured to only contact a surface associated with either the moving member or stationary member when the striker and striker pad are one of proximate and contacting each other.

According to some optional embodiments of the invention, a discontinuity in the track may cause the friction pad to engage. For example, the discontinuity may be a depression in the track.

In some embodiments, the moving member may be a door on a centrifuge. Optionally, a roller may be mounted to the moving member and the track may be mounted to the stationary member. The moving member may move in a horizontal plane. Some embodiments of the present invention may include a second track and set of rollers mounted parallel to the first track and set of rollers.

In accordance with another embodiment of the present invention, a stopping system for a moving member located on stationary member is provided. The system includes means for moving attached to the moving member, means for stopping the moving member from moving in a first direction connected to the moving member, and means for arresting the moving member from bouncing back from a collision of the stopping means and moving in a second direction substantially opposite the first direction. The arresting means is configured to operate when the moving member is proximate to engage the stopping means.

In accordance with still another embodiment of the present invention, a method of stopping a rolling or sliding member is provided. The method includes the steps of moving the member along a pathway, altering the movement of the member with a discontinuity in the pathway, slowing the member at the discontinuity with a friction device engaged by the altered movement of the member, stopping the member with a resilient device, and preventing the member from bouncing back from the resilient device a significant amount with the friction device.

There has thus been outlined, rather broadly, certain embodiments of the invention, in order that the detailed description thereof may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

An embodiment in accordance with the present invention provides a door with rollers rolling on a track. When the door moves to the end of the track to an open position, the door encounters a stop which stops the door. A friction pad engages the door as the door nears the stop and slows the door down before the door encounters the stop and reduces the amount of bounce back the door experiences after encountering the stop.

Figure 1:
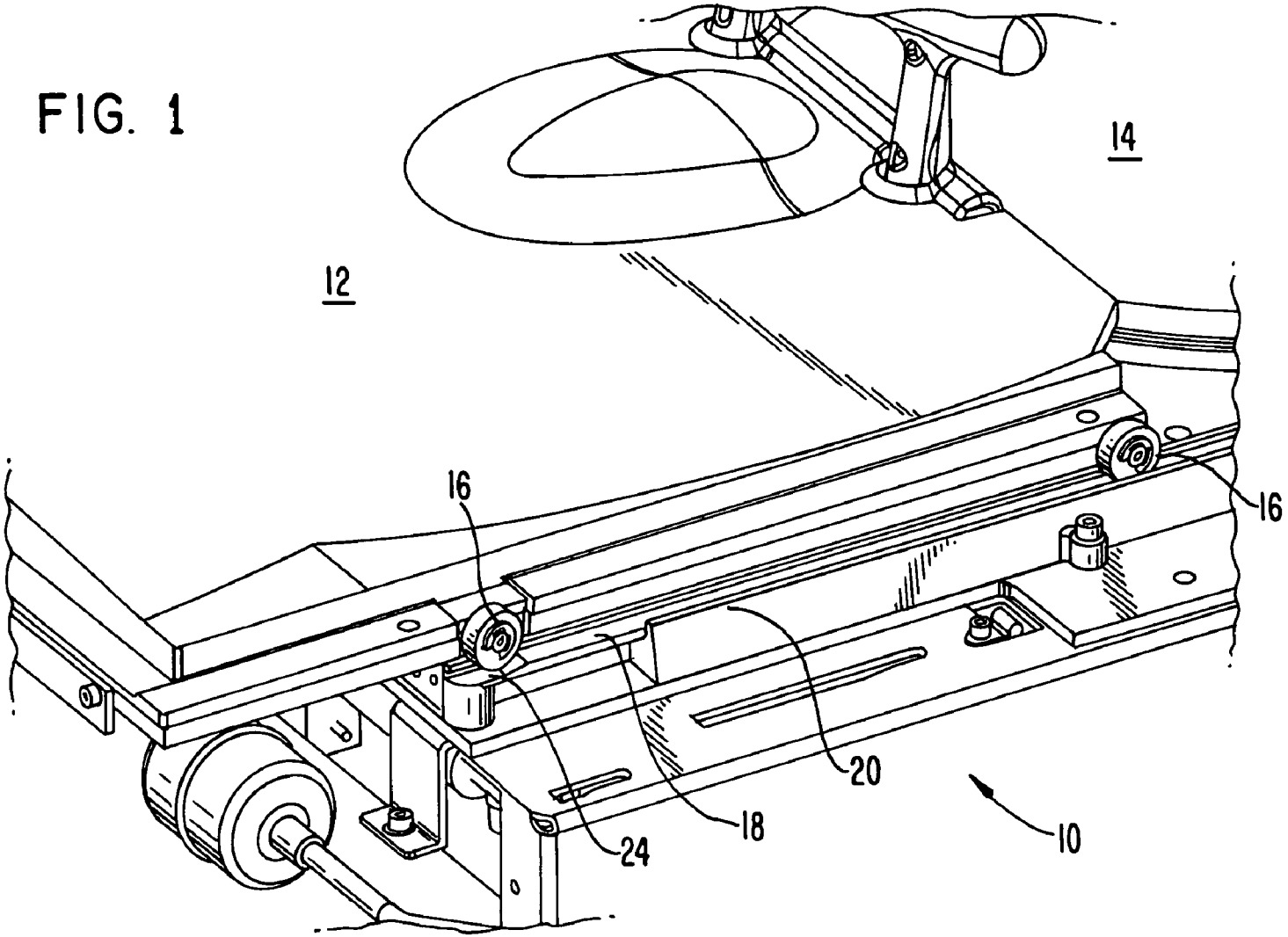
FIG. 1 is a partial perspective view illustrating a rolling door mounted to a centrifuge according to a preferred embodiment of the invention.

The invention will now be described with reference to the drawing figures, in which like reference numerals refer to like parts throughout. An embodiment of the present inventive apparatus is illustrated in FIG. 1, which shows a centrifuge 10 with a door 12 covering a chamber 14. The chamber 14 may be used for containing a rotor or some other apparatus associated with a centrifuge 10. The door 12 is capable of opening by moving aside. For example, the door 12 moves in a horizontal plane via rollers 16 which roll along a track 18. The track 18 includes a guide rail 20 as shown in FIG. 1. Alternatively, the track 18 may include wheel guides 22 shown in FIGS. 2 and 3. The guide rail 20 or wheel guides 22 may help the rollers 16 stay aligned properly on the track 18. Other embodiments of the invention may include sliders that move along a pathway rather than rollers 16.

According to some embodiments of the invention, the track 18 includes a discontinuity 24 for altering the movement of the door 12 in a horizontal plane. The discontinuity is preferably a depression 24. As the roller 16 moves along the track 18, the roller 16 encounters the depression 24. The roller 16 follows the depression 24, and thus alters the movement of the door 12 from a strictly horizontal movement to movement having horizontal and slightly vertical components.

While the embodiment shown in FIG. 1 includes rollers 16, other embodiments in accordance with the invention may alternatively include sliding elements or sliders rather than rollers, that slide along a track having a discontinuity similar to the discontinuity described above. While the embodiments shown in FIGS. 1–5, and the discussion herein is directed to a door moving in a horizontal plane, the invention is not limited to horizontally moving doors. The inventing can be made to accommodate a door or other moving member moving along a pathway in any plane.

Although, the discontinuity is preferably a depression 24 in the track 18, other discontinuities may include, for example, a turn in the track to either the right or left. Other discontinuities in accordance with the invention may also include a rise of the track or any other type of discontinuity.

Figure 2:
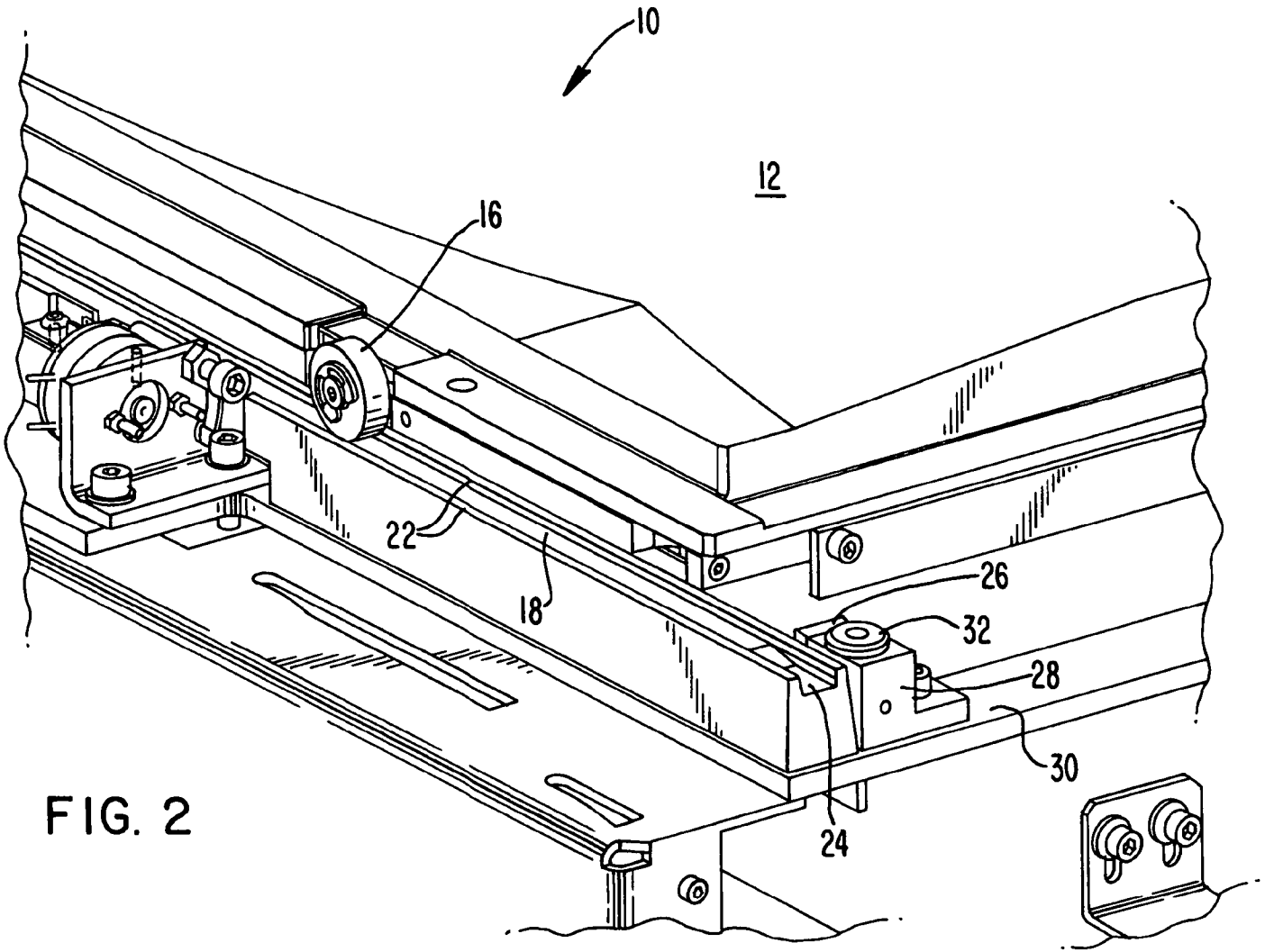
FIG. 2 is a partial perspective view of the rolling door mounted on the centrifuge.

FIG. 2 illustrates some of the elements used to stop the door 12. A stopping pad 26 is mounted to a pad mount 28. The stopping pad 26 may be made of resilient materials such as rubber, for example. The pad mount 28 is mounted to a frame 30 associated with the centrifuge 10. A friction pad 32 is also located on the top portion of the pad mount 28.

Figure 3:
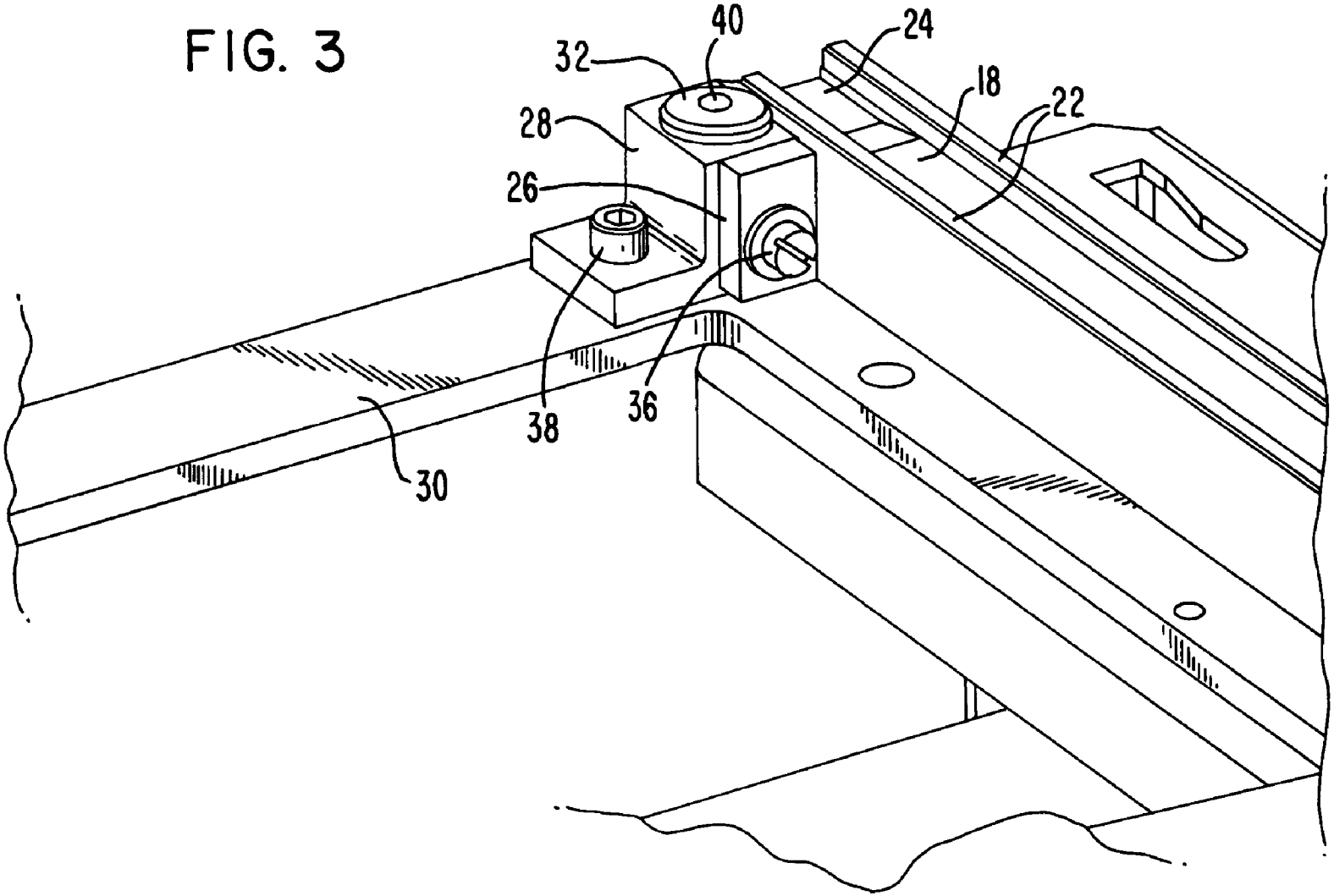
FIG. 3 is a partial perspective view showing a stopping pad for stopping the centrifuge door, a friction pad for slowing down the centrifuge door and a track for the rollers of the centrifuge door.

FIG. 3 illustrates a detailed view of the stopping pad 26 and the friction pad 32. The stopping pad 26 and the friction pad 32 are mounted to the pad mount 28. The stopping pad 26 is mounted to the pad mount 28 by a bolt 36. The pad mount 28 is mounted to the frame 30 by a bolt 38. The friction pad 32 contains a hole 40 which may be used and configured for receiving a bolt for mounting the friction pad 32 to the pad mount 28. The pad mount 28 is located near the track 18. The track 18 may include wheel guides 22 for keeping the wheels or rollers 16 (as shown in FIG. 1) aligned properly and keeping the wheels 16 on the track 18.

According to another embodiment of the present invention, a method of stopping a sliding or rolling door moving along a pathway is provided. The door moves along a pathway. As the door nears the end of the pathway, it encounters a discontinuity in the pathway causing an altered movement of the door. The altered movement causes the door to engage a friction device. Engaging the friction device causes the door to slow down. The method further includes stopping the door with a resilient device. The door is encumbered from bouncing back from the resilient device a significant amount due to the friction device acting on the door and dampening its movement. The door is closed by being moved along the pathway in the opposite direction. When the door encounters the discontinuity in the pathway when moving in the closed direction, the door moves according to the discontinuity in the pathway. This closing movement of the door according to the discontinuity causes the door to disengage the friction device, and thus the door can move freely to close.

The operation of the apparatus will now be described. As the door 12 moves along the track 18 and encounters the depression 24, the door 12 moves down slightly as the roller 16 follows the depression 24. The downward movement of the door 12 causes the bottom surface 34 of the door 12 to encounter the friction pad 32. The bottom surface 34 of the door 12 sliding along the friction pad 32 causes the door 12 to slow down before the door 12 encounters the stopping pad 26. After the door 12 encounters the stopping pad 26, the door 12 will stop moving along the track 18 in the initial direction of movement the door 12. If the door 12 strikes the stopping pad 26 with sufficient speed, the resilient material in the stopping pad 26 may tend to cause the door 12 to bounce back along the track 18 in a direction opposite the door's 12 initial direction. However, the friction pad 32 will still be in contact with the bottom surface 34 of the door 12 and will dampen the door's 12 bounce back movement.

To shut the door 12, the operator will move the door 12 along the track 18 in the opposite direction of the opening movement (the shutting direction is the same direction as the bounce back movement). When the roller 16 leaves the depression 24, the friction pad 32 will disengage from the bottom surface 34 of the door 12 and the door 12 will be able to freely shut.

Figure 4:
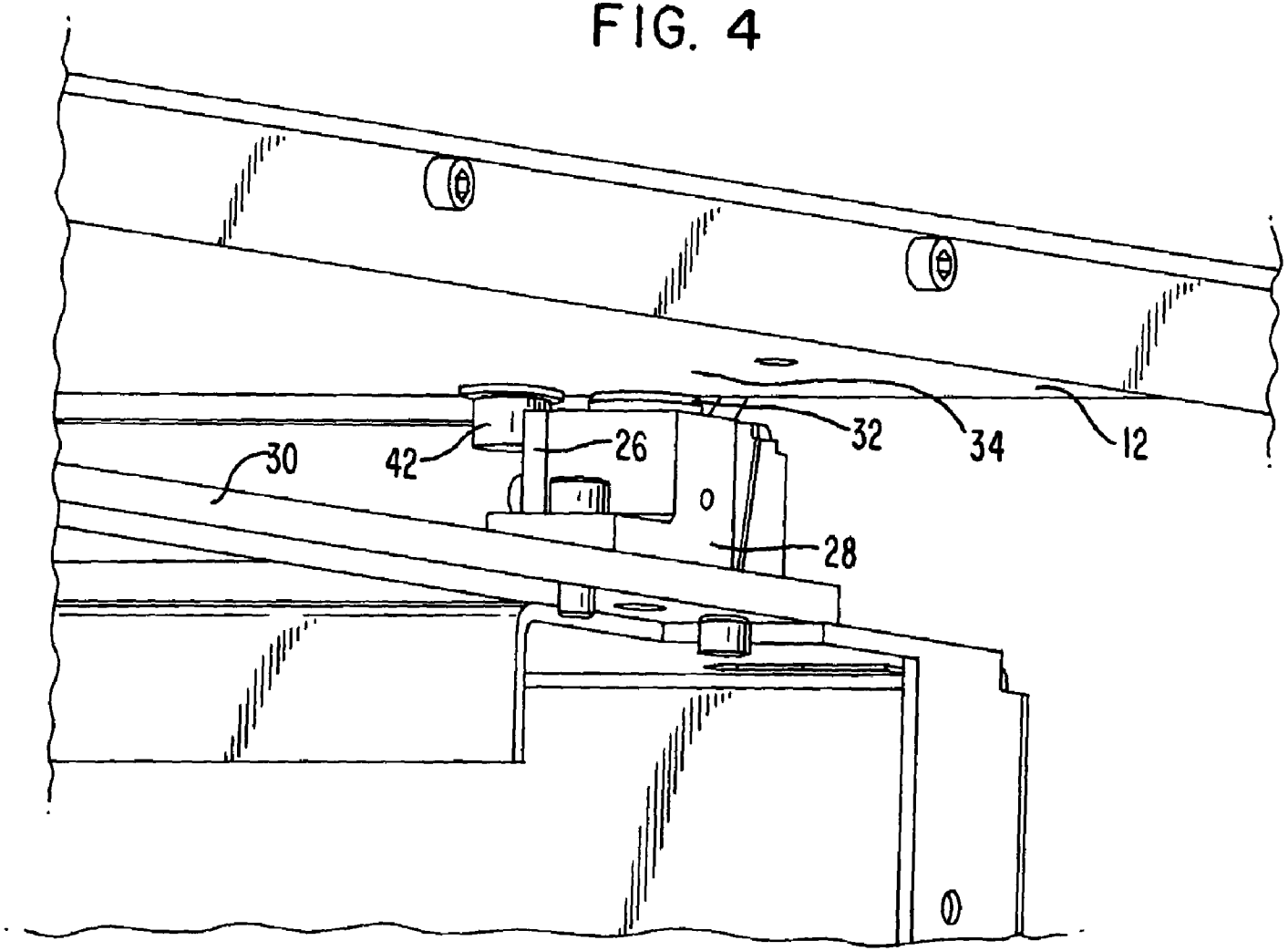
FIG. 4 is a partial perspective view showing the centrifuge door where a striker is engaged with the stopping pad and the friction pad is engaged with the centrifuge door.

FIG. 4 illustrates the door 12 encountering the friction pad 32 and the stopping pad 26. A striker 42 is mounted to the undersurface 34 of the door 12 in a manner as to encounter the stopping pad 26 when the door 12 has reached the end of the track 18. When the striker 42 encounters the stopping pad 26, the door 12 is stopped from moving along the track 18. As shown in FIG. 4, the friction pad 32 is engaging the undersurface 34 of the door 12. The undersurface 34 of the door 12 will slide along the friction pad 32 and slow the door 12. When the striker 42 encounters the stopping pad 26 the door is stopped.

If the striker 42 hits the resilient material of the stopping pad 26 at a high rate of speed, the door 12 may have a tendency to bounce back from the stopping pad 26. However, because the undersurface 34 of the door 12 is in contact with the friction pad 32, any bounce back movement is dampened by the friction pad 32 skidding along the undersurface 34 of the door 12.

The view shown in FIG. 4 when the friction pad 32 is engaged with the undersurface 34 of the door 12 is not the normal condition of the door 12. The undersurface 34 of the door 12 does not encounter the friction pad 32 when the door 12 is normally moving along the track 18. However, when the rollers 16 roll down the depression 24 in the track 18, the door 12 is lowered sufficiently to engage the friction pad 32 as shown in FIG. 4.

Figure 5:
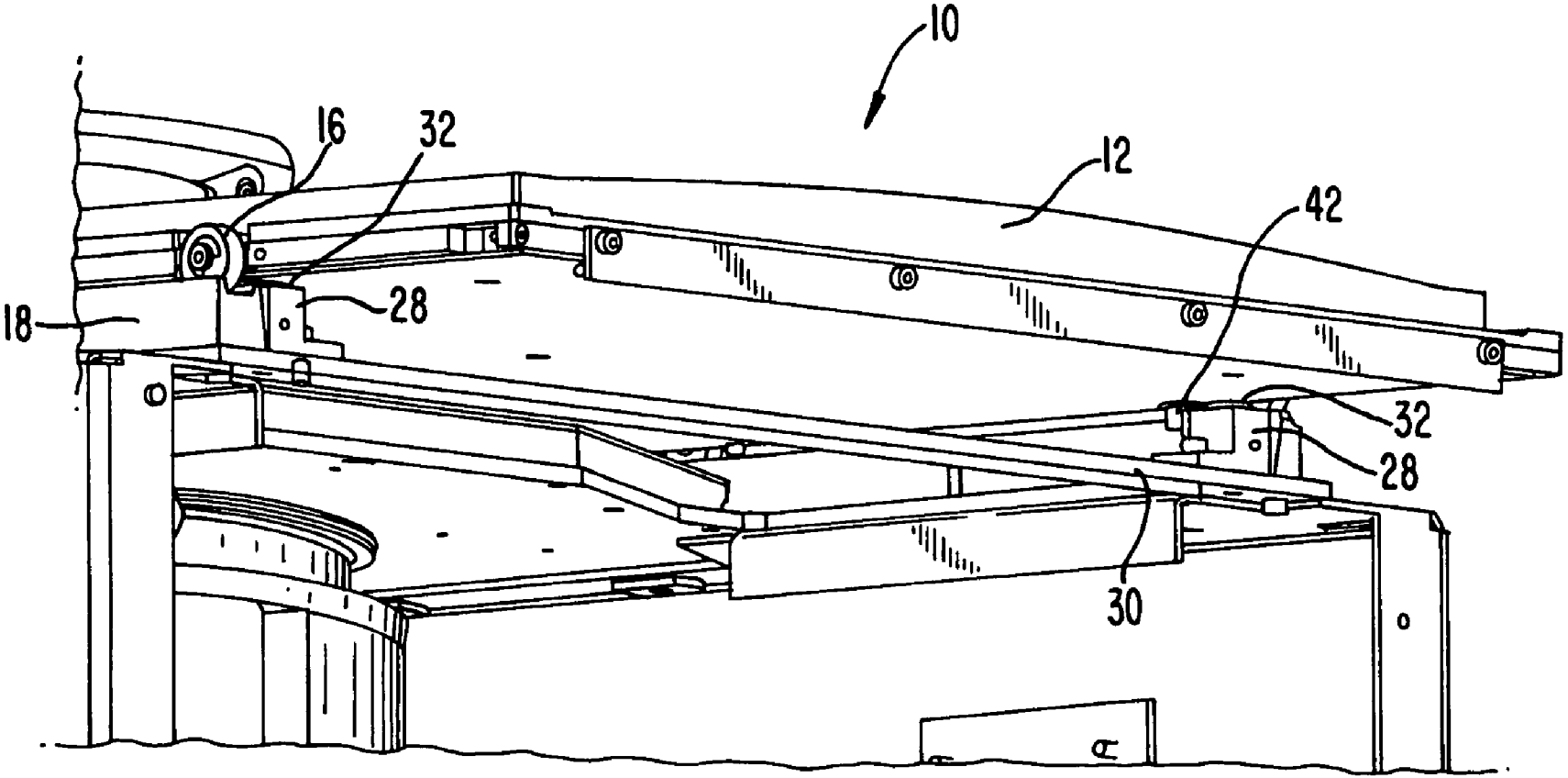
FIG. 5 is a partial perspective view showing the centrifuge door having two stopping pads and two friction pads for stopping the door.

FIG. 5 illustrates an embodiment according to the present invention where the door 12 contains a set of rollers 16 on one side of the door 12, and one set of rollers 16 on the other side of the door 12. In addition, a corresponding second track 18 is included. The embodiment shown in FIG. 5 further includes two pad mounts 28 with stopping pads 26 and friction pads 32 mounting on the stopping pad 28. The pad mounts 28 are mounted on the frame 30. The friction pads 32 and stopping pads 26 are positioned so that the door 12 encounters both friction pads 32 at the same time and both stopping pads at the same time.

Although the embodiments shown are used for moving a door in a horizontal plane on a centrifuge, the invention is not limited to centrifuges only but can be used for stopping any sort of rolling or sliding member. The invention is not necessarily limited to a door or to horizontal movement. It will be appreciated that other applications of the invention can be used on other apparatus besides centrifuges. It would also be appreciated that other discontinuities other than depressions may be used and the moving member may not use rollers but may include sliders.

Although an example of the device is shown with the rollers 16 mounted to the door 12 and the track 18 mounted to the centrifuge 10, it will be appreciated that other configurations can be used. For example, the track 18 may be mounted to the door 12 and the rollers 16 may be mounted to the centrifuge 10. Other configurations may be used according to the requirements of a specific application.

While the embodiments shown and described herein are configured to stop a door in the open position, other embodiments in accordance with the invention may include mounting the door stopping apparatus to stop the door in a closed position. One skilled in the art will appreciate how to accomplish adapting the invention described herein to be used to stop a door in the closed position.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A stopping system for stopping a moving member located for movement on a stationary member, comprising:

at least one of a first roller and a first slider attached to one of the moving member and the stationary member;

a first track connected to the other of the moving member and the stationary member, the first track configured to define a path for the at least one of the first roller and first slider;

a first striker pad connected to at least one of the moving member and the stationary member;

a first striker connected to the other of the moving and the stationary member, the first striker and first striker pad configured to contact each other to stop the moving member from moving in a first direction along the first track; and a first friction pad configured to resist the moving member from bouncing back from a collision of the first striker and first striker pad and from moving in a second direction substantially opposite the first direction and configured to only contact a surface associated with at least one of the moving member and stationary member when the striker and striker pad are proximate to engagement with each other.

2. The system of claim 1, wherein a discontinuity in the track causes the surface to engage the friction pad.

3. The system of claim 2, wherein the discontinuity is a depression in the track.

4. The system of claim 1, wherein the moving member is a door on a centrifuge.

5. The system of claim 1, wherein a roller is attached to the moving member and the track is attached to the stationary member.

6. The system of claim 1, further comprising a second system comprising:

at least one of a second roller and a second slider attached to one of the moving member and the stationary member;

a second track connected to the other of the moving member and the stationary member, the second track configured to define a path for the at least one of the second roller and second slider;

a second striker pad connected to at least one of the moving member and the stationary member;

a second striker connected to the other of the moving and the stationary member, the second striker and second striker pad configured to contact each other to stop the moving member from moving in the first direction along the second track; and a second friction pad configured to resist the moving member.

7. The system of claim 1, wherein the moving member moves in a substantially horizontal plane.

8. The system of claim 1, wherein the striker pad is comprised of a resilient material.

9. The system of claim 1, wherein the friction pad is comprised of a resilient material.

* * * * *